US006853890B1

(12) United States Patent
Horst et al.

(10) Patent No.: US 6,853,890 B1
(45) Date of Patent: Feb. 8, 2005

(54) PROGRAMMABLE REMOTE CONTROL SYSTEM AND APPARATUS FOR A LOCOMOTIVE

(75) Inventors: Folkert W. Horst, Pierrefonds (CA); Oleh Szklar, St-Hubert (CA)

(73) Assignee: Beltpack Corporation, Montreal (CA)

( * ) Notice: Subject to any disclaimer, the term of this patent is extended or adjusted under 35 U.S.C. 154(b) by 0 days.

(21) Appl. No.: 10/667,642

(22) Filed: Sep. 22, 2003

(51) Int. Cl.[7] ..... G06F 7/00; G06F 17/00

(52) U.S. Cl. ..... 701/20; 701/19; 701/33; 246/187 A; 340/825.69

(58) Field of Search ..... 701/19, 20, 24, 701/33, 36; 246/187 A; 340/825.69

(56) References Cited

U.S. PATENT DOCUMENTS

| | | | | |
|---|---|---|---|---|
| 4,519,002 A | * | 5/1985 | Amano | 386/46 |
| 4,641,292 A | | 2/1987 | Tunnell et al. | |
| 4,687,258 A | * | 8/1987 | Astley | 303/3 |
| 4,725,956 A | | 2/1988 | Jenkins | |
| 4,872,195 A | | 10/1989 | Leonard | |
| 4,893,240 A | | 1/1990 | Karkouti | |
| 5,039,038 A | * | 8/1991 | Nichols et al. | 246/3 |
| 5,284,097 A | * | 2/1994 | Peppin et al. | 104/88.02 |
| 5,479,156 A | * | 12/1995 | Jones | 340/5.64 |
| 5,511,749 A | | 4/1996 | Horst et al. | |
| 5,685,507 A | * | 11/1997 | Horst et al. | 346/187 A |
| 5,832,440 A | | 11/1998 | Woodbridge et al. | |
| 6,449,536 B1 | | 9/2002 | Brousseau et al. | |
| 6,456,674 B1 | | 9/2002 | Horst et al. | |
| 6,466,847 B1 | | 10/2002 | Horst | |
| 6,470,245 B1 | | 10/2002 | Prouix | |

FOREIGN PATENT DOCUMENTS

| | | |
|---|---|---|
| DE | 197 43 306 | 4/1999 |
| EP | 0 971 330 | 1/2000 |
| JP | 60059901 | 6/1985 |
| WO | 99/05015 | 2/1999 |

OTHER PUBLICATIONS

English–language translation of DE 197 43 306 dated Apr. 8, 1999.

English–language abstract of JP 60059901dated Jun. 4, 1985.

* cited by examiner

*Primary Examiner*—Gertrude A. Jeanglaude
(74) *Attorney, Agent, or Firm*—Ladas & Parry LLP

(57) ABSTRACT

The present invention relates to a remote control system for a locomotive having a control interface. The remote control system comprises a portable remote control device and a locomotive control device. The portable remote control device receives command data indicative of speed information, and generates digital command signals for transmission to the locomotive control device for conveying the command data. The locomotive control device is adapted to be mounted on board a locomotive, and is operative for receiving the command signals conveyed by the portable remote control device. The locomotive control device includes a control entity that is responsive to the signal conveyed by the remote control device for deriving a specific speed associated to the command data, wherein the specific speed is a configurable parameter. Finally the control entity is operative for issuing local control signals to the locomotive control interface for causing the locomotive to implement the specific speed.

43 Claims, 6 Drawing Sheets

PROGRAMMABLE REMOTE CONTROL SYSTEM AND APPARATUS FOR A LOCOMOTIVE

FIELD OF THE INVENTION

The present invention relates to a system and apparatus for remotely controlling a locomotive. More particularly, the invention relates to a remote control system and apparatus for a locomotive that has user configurable control parameters.

BACKGROUND OF THE INVENTION

Remote control systems for controlling locomotives are known in the art. Broadly stated, a remote control system for a locomotive has two main components, namely a remote control device and a locomotive control device. Typically, the locomotive control device is mounted on board the locomotive and is adapted for receiving command signals sent by the remote control device over a wireless communication link. The remote control device is typically a portable unit that is carried by a human operator located at a certain distance from the locomotive. When the operator would like to cause a movement of the locomotive in a certain direction, or at a certain speed, for example, he or she manipulates the controls on the remote control device in order to specify the desired parameters (i.e. forward, backwards, speed, etc.). The parameters are encoded into a command signal, which is sent by the remote control device to the locomotive control device. The locomotive control device processes the command signal and issues local control signals to a control interface for causing the desired commands to be implemented by the locomotive.

Typically, locomotive remote control systems are designed for controlling a locomotive in a specific railroad environment. For example, a system may be designed for controlling locomotives within a certain geographical region, by a certain operator, or during a certain time of day. A reason for designing locomotive remote control systems for controlling locomotives under certain conditions is that it allows safety requirements to be built into the system. A common example of this can be found in remote control systems that are operative to control locomotives located within a switchyard. The remote control systems that are used to control locomotives located within a switchyard are designed such that a user is able to transmit a predetermined set of commands to instruct the locomotives to move at predetermined speeds within the switchyard.

A deficiency with existing remote control systems is that a single remote control system is unable to be used to control a locomotive in a wide range of different situations, and under different conditions. For example, a remote control system that is designed to control a locomotive in a switchyard, may not be suitable to control the locomotive outside the switchyard. As such, in order to be able to control a locomotive in many different situations, and under many different conditions, different remote control systems, or at least different operator remote control devices, are needed. This is both expensive and inconvenient.

Against this background, it appears that there exists a need in the industry to develop a remote control system for a locomotive that reduces the costs and inconvenience associated with existing remote control systems.

SUMMARY OF THE INVENTION

In accordance with a first broad aspect, the invention provides a portable remote control device for a locomotive remote control system that includes a locomotive control device mounted on-board a locomotive. The portable remote control device comprises an input, a control unit and a transmission unit. The input is adapted to receive command data indicative of speed information. The control unit is operative to derive a specific speed associated to the command data, wherein the specific speed is a user configurable parameter. The control unit then generates digital command signals for instructing the locomotive to acquire the specific speed. Finally, the transmission unit, which is in communication with the control, is operative to generate an RF transmission conveying the digital command signals to the locomotive control device.

In a specific example of implementation, the portable remote control device comprises a second input for receiving speed programming information. The programming information is operative for causing the specific speed associated to the command data to be modified.

In another broad aspect, the invention provides a locomotive control device for use in a locomotive having a control interface. The locomotive control device comprises a communication entity and a control entity. The communication entity is in communication with the control entity, and is adapted for receiving signals from a remote control unit over a wireless communication link conveying the command data indicative of speed information. The communication entity is responsive to the signal conveyed by the remote control device for deriving a specific speed associated to the command data, wherein the specific speed is a configurable parameter. The communication entity then issues local control signals to the control interface for causing the locomotive to move at the specific speed.

In another broad aspect, the present invention provides a portable remote control device for a locomotive control system having a locomotive control device mounted on-board a locomotive. The remote control device comprises a speed input having a plurality of possible settings individually selectable by a user, a control unit in communication with the speed input for receiving from the speed input data indicative of a setting selected by a user. The control unit includes a speed map to associate a specific speed to the setting selected by the user. The speed map is user programmable to allow a user to change the specific speeds associated with the respective speed settings of the speed input. The remote control device further includes a transmission unit to generate an RF signal for conveying the specific speed to the locomotive control device.

In accordance with yet another broad aspect, the invention provides a remote control system for a locomotive having a control interface. The remote control system comprises a portable remote control device and a locomotive control device. The portable remote control device has an input for receiving command data indicative of speed information, a control unit that is in communication with the input for receiving the command data indicative of speed information and for generating digital command signals for controlling the speed of the locomotive, and a transmission unit in communication with the control unit for receiving the digital command signals and for generating an RF transmission conveying the digital command signals to the locomotive control device. The locomotive control device that is adapted to be mounted on board a locomotive, has a control entity and a communication entity in communication with the control entity. The communication entity is adapted for receiving over a wireless communication link the command signals indicative of speed information conveyed by the portable remote control device. The control entity is responsive to the signal conveyed by the remote control device for deriving a specific speed associated to the command data, wherein the specific speed is a configurable parameter. Finally the control entity is operative for issuing local control signals to the control interface for causing the locomotive to move at the specific speed.

BRIEF DESCRIPTION OF THE DRAWINGS

A detailed description of examples of implementation of the present invention is provided hereinbelow with reference to the following drawings, in which.

Figure 1:
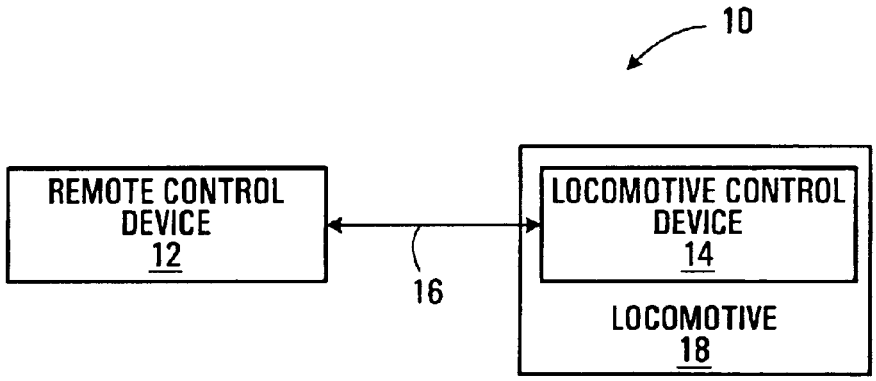
FIG. 1 shows a simplified block diagram of a remote control system for a locomotive in accordance with a specific example of implementation of the present invention.

In the drawings, embodiments of the invention are illustrated by way of example. It is to be expressly understood that the description and drawings are only for the purposes of illustration and as an aid to understanding, and are not intended to be a definition of the limits of the invention.

DETAILED DESCRIPTION

Shown in FIG. 1 is a high-level block diagram of a remote control system 10 in accordance with a specific example of implementation of the present invention. The remote control system 10 includes two main components; namely a portable remote control device 12 and a locomotive control device 14, which is mounted on board a locomotive 18. The portable remote control device 12 and the locomotive control device 14 are linked to one another by a wireless communication link 16.

Figure 2A:
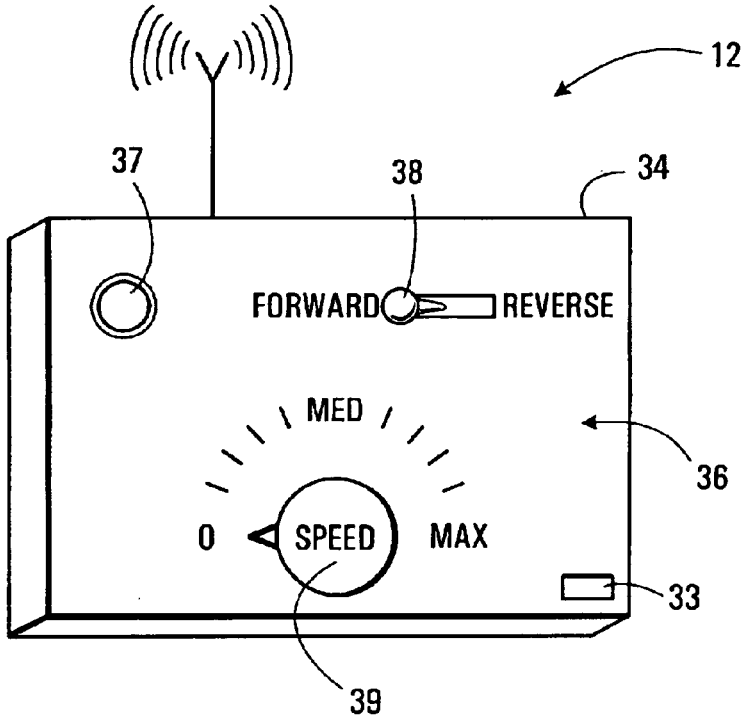
FIG. 2*a* shows a first specific example of a physical implementation of a portable remote control device.
Figure 2B:
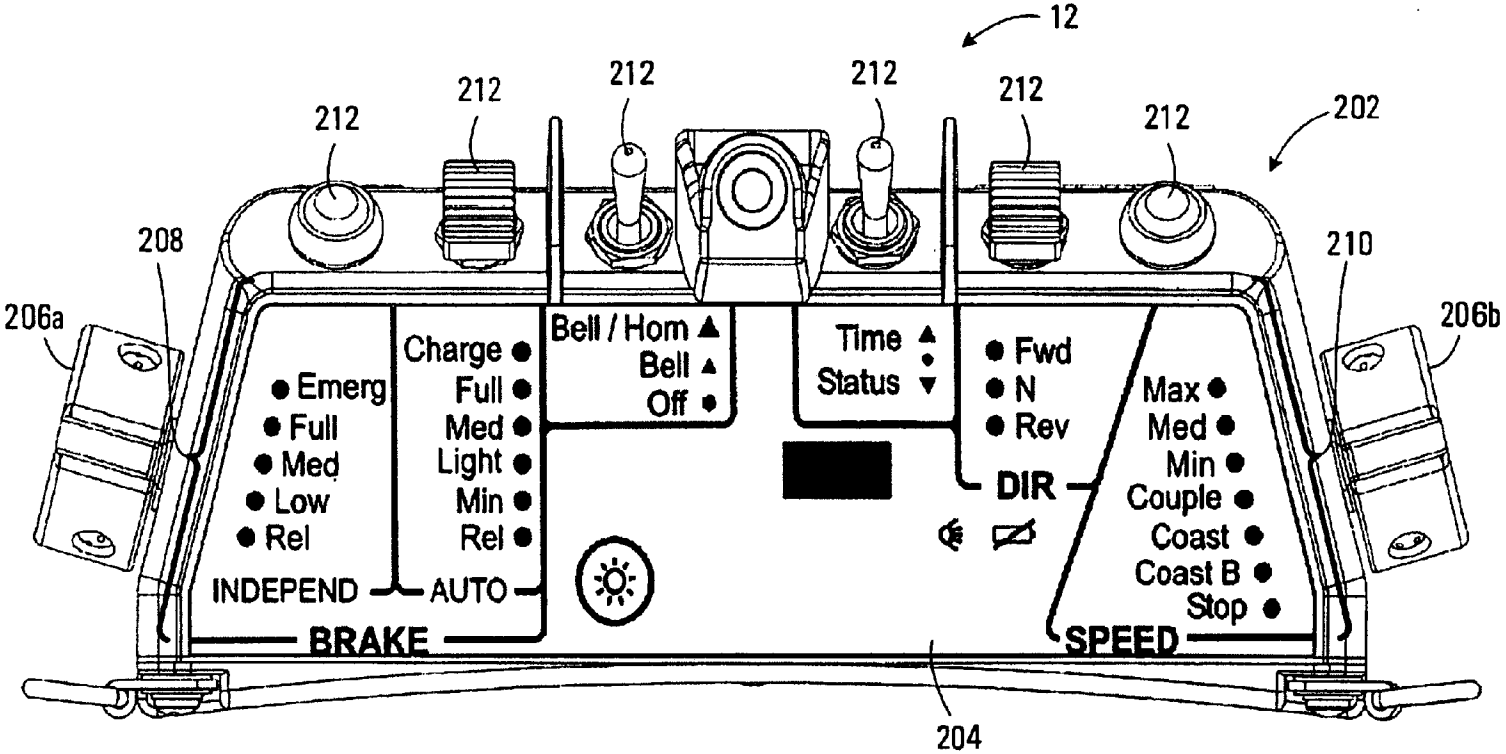
FIG. 2*b* shows a second specific example of a physical implementation of a portable remote control device.

In a specific example of implementation, the portable remote control device 12 is adapted for being carried by a human operator that may be located at a certain distance from the locomotive 18. Two specific, non-limiting, examples of physical layouts of the remote control device 12 are shown in FIGS. 2*a* and 2*b*. The remote control device 12 shown in FIG. 2*a* is in the form of a portable unit that includes a housing 34 for enclosing the electronic circuitry, a battery for supplying electrical power (not shown) and a user interface 36 for enabling the user to enter command data indicative of commands to be implemented by the locomotive 18. In the specific embodiment shown, the user interface 36 includes a power button 37 for turning the remote control device on and off, a speed dial 39 and a forward/backwards switch 38. Furthermore, the remote control device 12 includes an infrared communication port 33, which will be described in more detail further on.

The remote control device 12 shown in FIG. 2*b* is also in the form of a portable unit that includes a housing 202, a battery for supplying electrical power (not shown) and a user interface 204 for enabling the user to enter command data indicative of commands to be implemented by the locomotive 18. In the specific embodiment shown, the user interface 204 includes two dials 206 located on either side of the housing 202, that are able to be manipulated by a user in order to enter command data. Specifically, by manipulating dial 206*a* located on the left, the user is able to enter brake commands. The brake command information is displayed to the user via display portion 208 shown on the front of the housing 202. By manipulating dial 206*b* located on the right, the user is able to enter speed commands. The speed command information is displayed to the user via display portion 210 shown on the front of the housing 202. Other commands, such as on/off, bell/horn activation and forward/reverse, can be entered via control knobs and buttons 212 located on the upper portion of the housing 202. Although two different embodiments of a remote control device 12 have been described herein, it should be understood that the physical implementation of the remote control device 12 can vary greatly without departing from the spirit of the invention.

Figure 3:
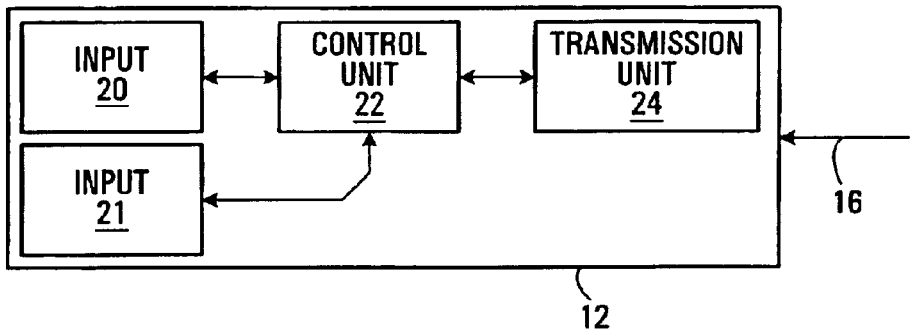
FIG. 3 shows a block diagram of a remote control device in accordance with a specific example of implementation of the present invention.

Shown in FIG. 3 is a functional block diagram of the remote control device 12. The remote control device 12 includes two inputs 20 and 21, a control unit 22 and a transmission unit 24. As a broad overview, input 20 is operative to receive command data from a user that is indicative of a desired command to be implemented by the locomotive. In a specific example of implementation, input 20 is a speed input having a plurality of possible settings that are individually selectable by a user. In the example shown in FIG. 2*b*, the plurality of possible settings that can be selected by a user are shown at display portion 210 of the user interface 204. It should be understood that the plurality of possible settings can be displayed and selected in a variety of different manners, and not just via dials, as shown in FIGS. 2*a* and 2*b*.

Input 21 is operative for receiving programming data, which will be described in more detail further on in the specification. Control unit 22 is in communication with input 20 and is operative to receive command data for generating command signals indicative of the command specified by the operator. The transmission unit 24, which is in communication with control unit 22, is operative to transmit the command signals to the locomotive control device 14.

Figure 4:
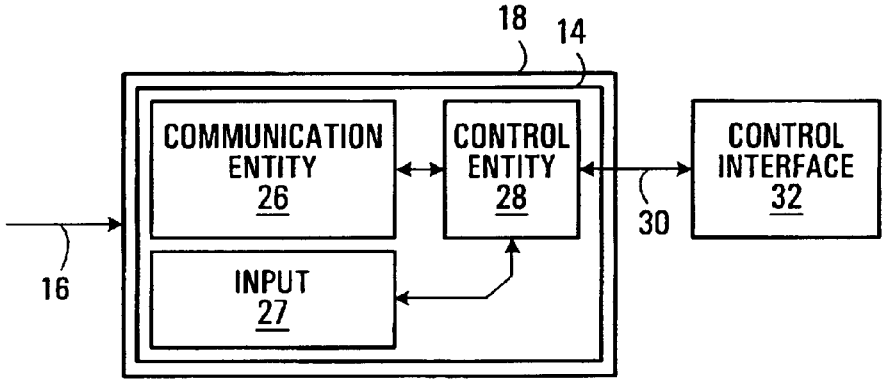
FIG. 4 shows a block diagram of a locomotive control device in communication with the control interface of the locomotive, in accordance with a specific example of implementation of the present invention.

Shown in FIG. 4 is a functional block diagram of the locomotive control device 14. The locomotive control device 14 includes a communication entity 26, an input 27 and a control entity 28. As a broad overview, the communication entity 26 is operative for receiving the command signals from the remote control device 12, and for passing the command signals to the control entity 28. Input 27 is operative for receiving programming signals, which will be described in more detail further on in the specification. The control entity 28 is responsive to the command signals from the remote control device 12 for issuing local control signals to a control interface 32, which causes the locomotive to implement the command specified by the user.

As used for the purposes of the present application, the term "control interface 32" refers globally to the collection of various actuators located on the train for executing various control signals issued by the control entity 28 of the locomotive control device 14. Examples of such actuators include the actuators that control the throttle, and the brakes, among others.

As described above with reference to FIG. 3, input 20 is operative to receive command data from a user. The command data can be indicative of any information for controlling the locomotive, such as speed information, braking information, direction information, etc. However, the present invention will be described below in relation to the scenario where input 20 receives command data indicative of speed information, such as a selected speed setting.

In a first specific example of implementation, the input 20 is adapted for receiving the command data indicative of speed information, such as a selected speed setting, from a user interface, such as user interface 36 depicted in FIG. 2*a* described above. In alternative examples of implementation, the user interface 36 or 204 can include a keyboard, buttons, levers, dials, a touch sensitive screen, a voice recognition unit, or any other suitable input device known in the art. In a second specific example of implementation, the input 20 is adapted for receiving the command data indicative of speed information from a wireless signal, such as an RF signal or an infrared signal.

The command data indicative of speed information can be in many different formats. For example, if a user enters the command data indicative of speed information via a dial or lever located on a user interface, the command data can be in the form of a selected speed setting, instead of an exact speed value. For example, the specific speed setting can be a minimum speed position, a medium speed position or a maximum speed position. The minimum speed position would be when the dial is all the way down, the medium speed position would be when the dial is at the mid-way point, and the maximum speed position would be when the dial is turned all the way up, for example. In addition to these three positions, there can be incremental speed positions located between the minimum speed position, the medium speed position and the maximum speed position. In the example shown in FIG. 2, there are four speed increments between the off position and the medium speed position, and there are four speed increments between the medium speed position and the maximum speed position.

As an alternative example, the command data can be in the form of an exact speed value the operator would like the locomotive to travel, such as 110 km/hr, for example. Command data in the form of an exact speed value can also be received from a user via a wireless signal, via a keyboard or keypad, or via a selection switch.

Once input 20 has received command data indicative of speed information, the remote control system 10 derives a specific speed associated to the command data indicative of speed information that can be acquired by the locomotive. In accordance with the present invention, the specific speed associated with the command data is configurable. In other words, the specific speed associated to a certain command data indicative of speed information at one point in time can be modified such that the specific speed associated to the same command data indicative of speed information at another point in time is different.

There are many different scenarios in which it would be desirable for the remote control system 10 to have the specific speeds associated with the command data be configurable. For example it may be desirable to have the specific speeds be modified depending on the time of day, depending on the operator controlling the locomotive (i.e. the speeds associated to command data might be higher for a more experienced operator), or depending on the geographical location of the locomotive. A benefit associated with having configurable speeds, is that it renders the remote control system more versatile, such that a single system, or a single remote control device 12, can be used in many different circumstances.

The versatility of remote control system 10 will now be described in more detail in relation to the specific example wherein the specific speeds associated to respective different command data are modified when the geographical region of the locomotive changes. Even more specifically, the remote control system 10 will be described in more detail in relating to the specific example wherein the specific speeds associated with respective different command data are modified when the locomotive moves from inside a switchyard to outside a switchyard.

For safety reasons, when a remote control system 10 is controlling a locomotive that is located within a switchyard, the locomotive is generally restricted to being able to move at a low maximum speed, such as 10 km/hr for example. Therefore, it is undesirable that the remote control device 10 be able to instruct the locomotive to move at a speed above that restricted maximum speed, such that an operator cannot accidentally instruct the locomotive to move at a speed exceeding this maximum speed. However, once the locomotive is outside the switchyard, the locomotive is not restricted to travelling at the low maximum speed, meaning that it is now able to travel at a much higher maximum speed. Consequently, it is desirable that the remote control system 10 be able to instruct the locomotive to move at the higher maximum speed. As such, the specific speeds associated with respective command data are configurable such that they can be modified in order to enable the remote control system to control the locomotive when the locomotive is located both inside and outside a switchyard.

As a non-limiting example, assume that the maximum speed for a locomotive traveling inside a switchyard is 10 km/hr, and that the maximum speed for a locomotive traveling outside a switchyard is 150 km/hr. Therefore, when the command data indicative of speed information received at input 20 is a selected speed setting, and the remote control system 10 is being used to control a locomotive located within a switchyard, the specific speed associated to the "maximum speed position" would be 10 km/hr, and the specific speed associated to the "medium speed position" would be 5 km/hr. As mentioned above, if there are four increments between the off speed position and the medium speed position, and between the medium speed position and the maximum speed position then each increment is associated to an increment of 1 km/hr. However, when the remote control system 10 is being used to control the locomotive when the locomotive is located outside the switchyard, the specific speeds associated to the selected speed settings must be modified to reflect the change in the allowed maximum speed. Therefore, the specific speeds are modified such that the specific speed associated to the "maximum speed position" would be 150 km/hr, and the specific speed associated to the "medium speed position" would be 75 km/hr.

In the case where the command data indicative of speed information received at input is an exact speed, and the remote control system 10 is being used to control the locomotive when the locomotive is located in a switchyard, the remote control system 10 must ensure that the locomotive is restricted to 10 km/hr. As such, specific speeds associated to the exact speeds that are below 10 km/hr, are equivalent to the exact speeds specified by the user. However, the specific speeds associated to the exact speeds that are above 10 km/hr are always 10 km/hr, regardless of the exact speed specified by the user. As such, the remote control system 10 is unable to cause the locomotive to move at anything above 10 km/hr. However, when the remote control system 10 is being used to control the locomotive when the locomotive is located outside the switchyard, the specific speeds associated to the exact speeds specified by the user must be modified to reflect the change in the allowed maximum speed. Therefore, the specific speeds are modified such that the specific speeds associated to the exact speeds that are below 150 km/hr, are equivalent to that exact speeds specified by the user, however the specific speeds associated to the exact speeds that are above 150 km/hr are always 150 km/hr, regardless of the exact speed specified by the user.

Two examples of implementation are described below in which the remote control system 10 can derive a specific speed associated to the command data that is received at input 20. In a first specific example of implementation, the specific speed associated with the command data received at input 20 is derived by the remote control device 12, and in a second specific example of implementation, the specific speed associated with the command data received at input 20 is derived by the locomotive control device 14. Each of these specific examples of implementation will be described in more detail below.

Remote Control Device 12

Figure 5:
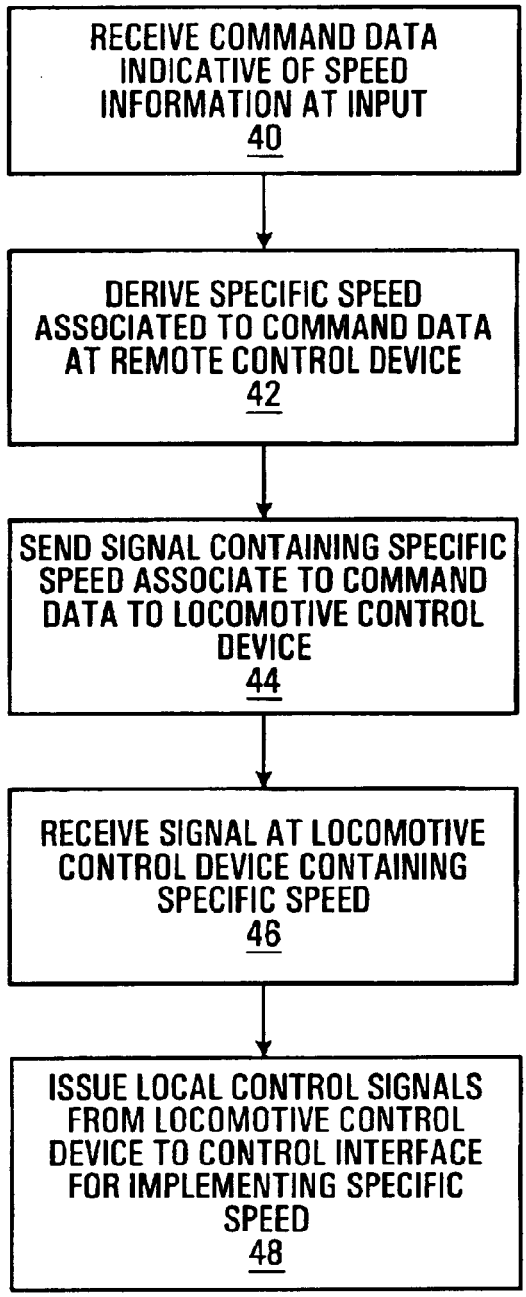
FIG. 5 shows a flow diagram of the method of the present invention, in accordance with a first specific example of implementation.

As mentioned above, in a first specific example of implementation the specific speed associated to the command data received at input 20 is derived by the remote control device 12. This embodiment will be described in more detail below with reference to the flow diagram shown in FIG. 5.

At step 40, a signal indicative of speed information is received at input 20. The signal is then passed to control unit 22, which is in communication with input 20. At step 42, control unit 22 derives a specific speed associated to the command data received at input 20.

In a specific, non-limiting example of implementation, the remote control device 12 includes a memory unit for storing a database that maps command data to respective specific speeds. The database can be considered a speed map that associates specific speeds to a plurality of possible speed settings. Table 1, below, is a specific, non-limiting example of a database that can be accessed by control unit 22 in order to derive a specific speed associated to received command data, which in this case is a selected speed setting.

TABLE 1

| Command Data | Associated Specific Speed |
|---|---|
| Minimum Speed | 0 km/hr |
| Medium Speed | 5 km/hr |
| Maximum Speed | 10 km/hr |

Referring to the database shown in Table 1, in the case where the command data received at input 20 is indicative of a Maximum Speed, the control unit 22 derives a specific speed of 10 km/hr as being associated to the received command data. In the case where the specific speeds associated to respective command data need to be modified, such as in the case where the locomotive moves outside the switchyard, the remote control device receives programming signals in order to replace the values of the associated specific speeds, with new values.

In a specific example of implementation, the remote control device 12 receives the programming signals for modifying or replacing the values of the specific speeds in the database, or speed map, via second input 21. Input 21 can be the same physical input as input 20 described above, or alternatively, input 21 can be a separate input, as shown in FIG. 3. In the case where input 21 is the same as input 20, the information for generating the programming signals can be received from user interface 36. Alternatively, in the case where input 21 is a separate input, it can be a wire-line input, or a wireless input. The wireless input can be in the form of an RF receiver or an infrared sensor, such as communication port 33 shown in FIG. 2*a* In the specific example of implementation wherein input 21 is in the form of an infrared sensor, a separate programming device that includes an infrared transmitter can be brought into visual communication with the infrared sensor of the remote control device 12. Once in visual communication, the separate programming device can transmit programming signals to the remote control device 12, for causing the specific speeds associated to the command data to be modified.

In an alternative example of implementation, the database can include more than one set of specific speeds associated to respective command data. For example, the database can include a first set of specific speeds associated to respective different command data that are adapted to be accessed by the control unit 22 when the locomotive is in a first geographical region, and a second set of specific speeds associated to respective different command data that are adapted to be accessed by the control unit 22 when the locomotive is in a second geographical region. Table 2, below, is a specific, non-limiting, example of a database that includes two sets of specific speeds, wherein the mapping of the command data to the specific speeds can be modified. The solid arrows are indicative of the mapping when the locomotive is in a first geographical region, and the dashed-line arrows are indicative of the mapping when the locomotive is in a second geographical region.

TABLE 2

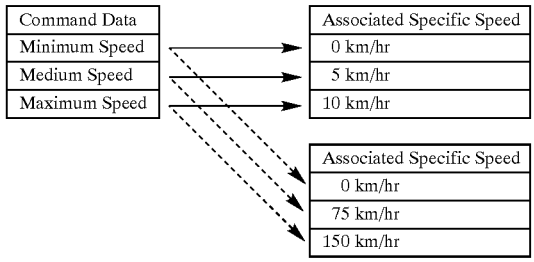

In a specific example of implementation, the control unit 22 can switch between the two sets of specific speeds in response to the reception of signals at second input 21. Although only two sets of specific speeds have been indicated above, it should be understood that more than two sets of specific speeds can be included without departing from the spirit of the invention.

A signal indicating to switch between specific sets of speeds may be input by a user via a user interface, such as an actuator switch that indicates "in switch yard" or "out of switchyard", for example. Or alternatively, the signal can be input via a programming device as described above. In yet another example of implementation wherein the mapping of the specific speeds to respective command data is to be modified when the geographical location of the locomotive changes, then the remote control device 12 can be in communication with a GPS system or a transponder system that transmits signals to the remote control device 12 when it senses that the locomotive has changed geographical position. As such, input 21 can be an RF receiver for receiving signals from a GPS satellite, or from a signal transmitted from the locomotive indicative that its geographical region has changed. The signals transmitted by the GPS system or the transponder system would cause the remote control device 12 to switch between the two or more sets of specific speeds that are stored within the database.

In a specific example of implementation, the change in geographical location may be a change from within a switchyard to outside a switchyard. Typically, a locomotive will commence a journey within a first switchyard, then exit the switchyard to travel the majority of its journey on railroad track that is outside a switchyard, and then finish its journey in a second switchyard that is different from the first. When the locomotive is within the first switchyard, the maximum speed that the locomotive is able to move may be 5 km/hr. Then, when the locomotive exits the switchyard, the maximum speed that the locomotive is able to move might be 100 km/hr. Therefore, in a specific example of implementation, the remote control device 12 might be in communication with a GPS satellite, that transmits a signal to the remote control device 12, when the locomotive has moved from within a switchyard to outside a switchyard, or vice versa.

Alternatively, the database may be contained in a separate unit from the remote control device 12 and that is adapted to establish contact therewith. For example, the database is in the form of a memory unit or memory card that can be inserted in the remote control device and read by the remote control device 12 during use. In a specific example of implementation, each specific user of the remote control device 12 can have a different memory card (or ID card) depending on their level of clearance, and as such, the memory card of each different user may include different specific speeds.

Once the control unit 22 has derived a specific speed associated to the command data received at input 20, the control unit 22 generates digital command signals for instructing the locomotive to acquire the derived specific speed value. These digital command signals are then sent to the transmission unit 24, which is in communication with the control unit 22. At step 44, the transmission unit 24 generates an RF transmission for conveying the digital command signals to the locomotive control device 14. In a specific example of implementation, communication link 16 is an RF communication link.

At step 46, the communication entity 26, shown in FIG. 4, receives the command signals sent from remote control device 12. Communication entity 26 is in communication with the control entity 28, for passing the command signals thereto.

Finally, at step 48, control entity 28 is responsive to the command signals conveyed by the remote control device 12, for issuing local control signals to a control interface 32 for causing the locomotive to move at the specific speed conveyed by the digital command signal received from the remote control device 12.

As shown in FIG. 4, control entity 28 is connected to control interface 32 over communication link 30.

Locomotive Control Device 14

Figure 6:
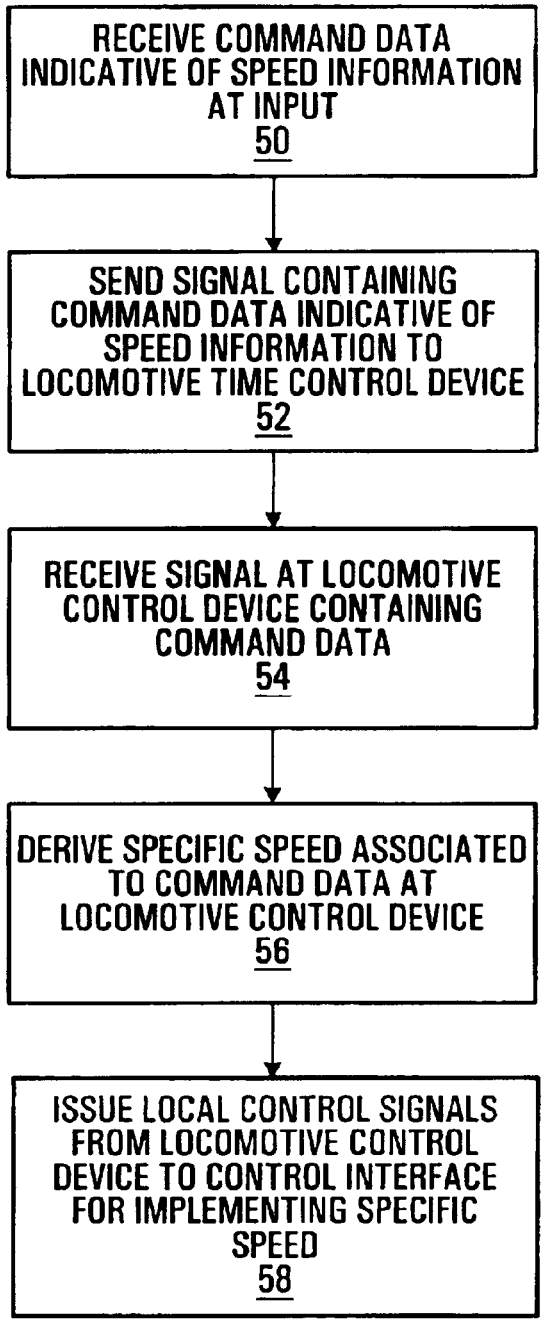
FIG. 6 shows a flow diagram of the method of the present invention, in accordance with a second specific example of implementation.

In a second specific example of implementation, the specific speed associated to the command data received at input 20 is derived by the locomotive control device 14. This embodiment will be described in more detail below with reference to the flow diagram shown in FIG. 6.

At step 50, a signal indicative of speed information is received at input 20 of remote control device 12. The signal is then passed to control unit 22 which generates command signals for forwarding the command data indicative of speed information to locomotive control device 14. At step 52, the transmission unit 24, which is in communication with control unit 22, generates an RE transmission for conveying the command signals to the locomotive control device 14 over wireless communication link 16.

At step 54, the command signals are received by the communication entity 26 of the locomotive control device 14 and are passed to the control entity 28. In this second specific example of implementation, the control entity 28 of the locomotive control device 14 derives a specific speed associated to the command data indicative of speed information. Therefore, at step 56, the control entity 28 derives the specific speed associated to the command data.

In a specific non-limiting example of implementation, the locomotive control device 14 includes a memory unit for storing a database that maps specific speeds associated to respective different command data. The database can be considered a speed map that associates specific speeds to a plurality of possible speed settings. Table 1, depicted above with respect to the remote control device 12, is a specific, non-limiting, example of a database that could be accessed by control entity 28 in order to derive a specific speed associated to the received command data.

Similarly to the embodiment described with respect to the remote control device 12, when the specific speeds associated to respective command data need to be modified, such as in the case where the locomotive moves outside the switchyard, the locomotive control device 14 receives programming signals in order to replace the values of the associated specific speeds, with new values.

In order to enable the specific speeds associated to respective different command data to be modified, locomotive control device 14 is able to receive programming signals via input 27. Input 27 is adapted for receiving signals containing programming information that is operative for causing the specific speeds associated to respective different command data to be modified. Input 27 can be in the form of a user interface that is part of the locomotive control device 12, or alternatively it can be a wire-line input, or a wireless input that includes an RF receiver or an infrared sensor. In the case where the input 27 includes an infrared sensor, a separate programming device that include an infrared transmitter can be brought into visual communication with the infrared sensor of the remote control device 12, in order to transmit programming signals to the locomotive control device 14, for causing the specific speeds associated to respective different command data to be modified.

In an alternative example of implementation, the database can include more than one set of specific speeds associated to respective different command data. For example, as described above with respect to Table 2, the database can include a first set of specific speeds associated to respective different command data that are adapted to be accessed by the control entity 28 when the locomotive is in a first geographical region, and a second set of specific speeds associated to respective different command data that are adapted to be accessed by the control entity 28 when the locomotive is in a second geographical region. The control entity 28 can switch between the two sets of specific speeds in response to the reception of signals at the input indicating that the geographical position of the locomotive has changed. Such a signal may be input by a user via a user interface. Or alternatively, the locomotive control device 14 can be in communication with a GPS system or a transponder system, that transmits signals to the locomotive control device 14 when the locomotive changes geographical position. The signals transmitted by the GPS system or the transponder system would cause the locomotive control device 14 to switch between the two or more sets of specific speeds that are stored within the database.

In yet another embodiment, the switch may depend on an operator password, or transponder type identity card. As such, the specific speeds associated to the command data can be dependent on a user's clearance level; meaning that perhaps more experienced users are able to have higher specific speeds associated to the command data.

Once the control entity 28 has derived a specific speed associated to the command data received at the communication entity, at step 58, the control entity 28 issues local control signals to the control interface 32, for causing the locomotive to acquire the derived specific speed. These local control signals are issued to the control interface 32 over communication link 30, which as described above can be a wire-line communication link or a wireless communication link.

It should be understood that in the embodiment wherein it is the remote control device 12 that is operable for deriving the specific speeds associated to the command data, it is not necessary for the locomotive control device 14 to include input 27. Likewise, in the embodiment wherein it is the locomotive control device 14 that is operable for deriving the specific speeds associated to the command data, it is not necessary for the remote control device 12 to include input 21. Therefore, depending on the embodiment being implemented, the inputs 21 and 27 are optional components.

Physical Implementation

Those skilled in the art should appreciate that in some embodiments of the invention, all or part of the functionality for deriving a specific speed described herein with respect to either one of control unit 22 and control entity 28, may be implemented as pre-programmed hardware or firmware elements (e.g., application specific integrated circuits (ASICs), electrically erasable programmable read-only memories (EEPROMs), etc.), or other related components.

In other embodiments of the invention, all or part of the functionality previously described herein with respect to either one of control unit 22 and control entity 28 for deriving a specific speed association with command data indicative of speed information may be implemented as software consisting of a series of instructions for execution by a computing unit. The series of instructions could be stored on a medium which is fixed, tangible and readable directly by the computing unit, (e.g., removable diskette, CD-ROM, ROM, PROM, EPROM or fixed disk), or the instructions could be stored remotely but transmittable to the computing unit via a modem or other interface device (e.g., a communications adapter) connected to a network over a transmission medium. The transmission medium may be either a tangible medium (e.g., optical or analog communications lines) or a medium implemented using wireless techniques (e.g., microwave, infrared or other transmission schemes).

Figure 7:
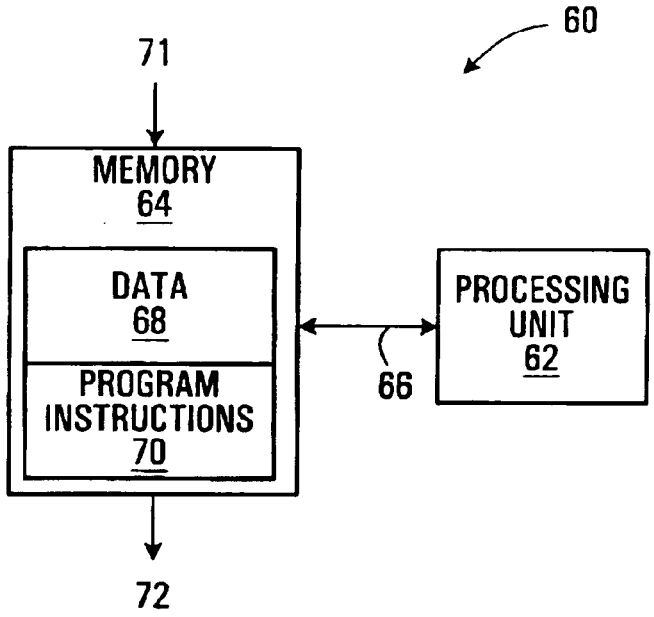
FIG. 7 shows a functional block diagram of a computing unit for performing the functionality of the control unit of the remote control device shown or the control entity of the locomotive control device, in accordance with a specific example of implementation of the present invention.

Either one, or both, of control unit 22 and control entity 28 may be configured as a computing unit 60 of the type depicted in FIG. 7, including a processing unit 62 and a memory 64 connected by a communication bus 66. The memory 64 includes data 68 and program instructions 70. The processing unit 62 is adapted to process the data 68 and the program instructions 70 in order to implement the system described in the specification and depicted in the drawings. The computing unit 60 may also comprise a number of interfaces for receiving or sending data elements to external devices. For example, interface 71 can be operative to receive signals from input 20 containing of command data indicative of speed information. The processing unit 62 is operative for processing the received signal or signals to derive a specific speed associated with the command data. Computing unit 60 may also comprise an interface 72 for releasing the data indicative of the specific speed derived.

Although various embodiments have been illustrated, this was for the purpose of describing, but not limiting, the invention. Various modifications will become apparent to those skilled in the art and are within the scope of this invention, which is defined more particularly by the attached claims.

What is claimed is:

1. A portable remote control device for a locomotive remote control system, the locomotive remote control system having a locomotive control device mounted on-board a locomotive, said portable remote control device comprising:

an input for receiving command data indicative of speed information for transmission to the locomotive control device;

a control unit that is in communication with said input for receiving the command data indicative of speed information, said control unit being operative:

a) to derive a specific speed associated to the command data, the specific speed being a configurable parameter; and b) to generate digital command signals for instructing the locomotive to acquire the specific speed;

a transmission unit in communication with said control unit for receiving the digital command signals and for generating an RF transmission conveying the digital command signals to the locomotive control device.

2. A portable remote control device as defined in claim 1, said device further comprising a second input for receiving signals containing programming information, said programming information being operative for causing the specific speed associated to the command data to be modified.

3. A portable remote control device as defined in claim 2, wherein said second input is adapted for receiving wireless signals.

4. A portable remote control device as defined in claim 3, wherein said second input includes an infrared communication port.

5. A portable remote control device as defined in claim 3, wherein said second input includes a radio frequency receiver.

6. A portable remote control device as defined in claim 3, wherein said second input includes a wire-line connection.

7. A portable remote control device as defined in claim 1, wherein said command data indicative of speed information includes command data for instructing the locomotive to acquire a maximum speed.

8. A portable remote control device as defined in claim 7, wherein said control unit is operative to derive a specific speed associated to the command data for instructing the locomotive to acquire the maximum speed, the specific speed associated to the maximum speed being a configurable parameter.

9. A portable remote control device as defined in claim 8, wherein said specific speed is a first specific speed, said first specific speed being associated to the maximum speed when said locomotive is in a first geographical region, said control unit being operative to derive a second specific speed associated to the maximum speed when the locomotive is in a second geographical region.

10. A portable remote control device as defined in claim 9, wherein a Global Positioning System (GPS) is used to determine whether the locomotive is in the first geographical region or the second geographical region.

11. A portable remote control device as defined in claim 10, wherein a transponder system is used to determine whether the locomotive is in the first geographical region or the second geographical region.

12. A portable remote control device as defined in claim 9, wherein said first geographical region is a switchyard, and said second geographical region is outside a switchyard.

13. A portable remote control device as defined in claim 2, wherein said command data indicative of speed information includes command data for instructing the locomotive to acquire one of a plurality of predetermined speeds.

14. A portable remote control device as defined in claim 9, wherein said control unit is operative to derive a specific speed associated to each of the plurality of predetermined speeds, the specific speeds associated to the plurality of predetermined speeds being configurable parameters.

15. A portable remote control device as defined in claim 2, further comprising a user interface that is operative for receiving from a user command data indicative of speed information.

16. A locomotive control device suitable for use in a locomotive having a control interface, said locomotive control device comprising:

a control entity;

a communication entity in communication with said control entity, said communication entity being adapted for receiving signals from a remote control unit over a wireless communication link conveying the command data indicative of speed information;

said control entity being responsive to the signal conveyed by the remote control device for:

a) deriving a specific speed associated to the command data, the specific speed being a configurable parameter; and b) issuing local control signals to the control interface for causing the locomotive to move at the specific speed.

17. A locomotive control device as defined in claim 16, said locomotive control device further comprising an input for receiving signals containing programming information, said programming information being operative for causing the specific speed associated to the command data to be modified.

18. A locomotive control device as defined in claim 17, wherein said input is adapted for receiving wireless signals.

19. A locomotive control device as defined in claim 18, wherein said input is adapted for receiving radio frequency signals.

20. A locomotive control device as defined in claim 18, wherein said input includes an infrared sensor.

21. A locomotive control device as defined in claim 17, wherein said input includes a wire-line connection.

22. A locomotive control device as defined in claim 16, wherein said command data indicative of speed information includes command data for instructing the locomotive to acquire a maximum speed.

23. A locomotive control device as defined in claim 22, wherein said control unit is operative to derive a specific speed associated to the maximum speed, the specific speed associated to the maximum speed being a configurable parameter.

24. A locomotive control device as defined in claim 23, wherein said specific speed is a first specific speed, said first specific speed being associated to the maximum speed when said locomotive is in a first geographical region, said control unit being operative to derive a second specific speed associated to the maximum speed when the locomotive is in a second geographical region.

25. A locomotive control device as defined in claim 24, wherein a Global Positioning System (GPS) is used to determine whether the locomotive is in the first geographical region or the second geographical region.

26. A locomotive control device as defined in claim 24, wherein a transponder system is used to determine whether the locomotive is in the first geographical region or the second geographical region.

27. A locomotive control device as defined in claim 26, wherein said first geographical region is a switchyard, and said second geographical region is outside a switchyard.

28. A locomotive control device as defined in claim 16, wherein said command data indicative of speed information includes command data for instructing the locomotive to acquire one of a plurality of predetermined speeds.

29. A locomotive control device as defined in claim 28, wherein said control unit is operative to derive a specific speed associated to each of the plurality of predetermined speeds, the specific speeds associated to the plurality of predetermined speeds being configurable parameters.

30. A remote control system for a locomotive having a control interface, said remote control system comprising:

a portable remote control device having:

a) an input for receiving command data indicative of speed information;

b) a control unit that is in communication with said input for receiving the command data indicative of speed information and generating digital command signals for controlling the speed of the locomotive;

c) a transmission unit in communication with said control unit for receiving the digital command signals and for generating an RF transmission conveying the digital command signals to a locomotive control device;

a locomotive control device suitable to be mounted on board a locomotive, said locomotive control device having:

a) a control entity;

b) a communication entity in communication with said control entity, said communication entity being adapted for receiving over a wireless communication link the command signals indicative of speed information conveyed by the remote control device;

c) said control entity being responsive to the signal conveyed by the remote control device for:

i) deriving a specific speed associated to the command data, the specific speed being a configurable parameter; and ii) issuing local control signals to the control interface for causing the locomotive to move at the specific speed.

31. A portable remote control device for a locomotive control system, the locomotive control system having a locomotive control device mounted on-board a locomotive, said remote control device comprising:

a speed input having a plurality of possible settings individually selectable by a user;

a control unit in communication with said speed input for receiving from said speed input data indicative of a setting selected by a user among said plurality of possible settings, said control unit including a speed map to associate a specific speed to the setting selected by the user, a transmission unit to generate an RF signal for conveying the specific speed to the locomotive control device;

said speed map being user programmable to allow a user to change the specific speeds associated with the respective speed settings of said speed input.

32. A portable remote control device as defined in claim 31, said device further comprising a second input for receiving signals containing programming information, said programming information being operative for causing the specific speeds associated with the respective speed settings of said speed input to be changed.

33. A portable remote control device as defined in claim 32, wherein said second input is adapted for receiving wireless signals.

34. A portable remote control device as defined in claim 33, wherein said second input includes an infrared communication port.

35. A portable remote control device as defined in claim 33, wherein said second input includes a radio frequency receiver.

36. A portable remote control device as defined in claim 33, wherein said second input includes a wire-line connection.

37. A portable remote control device as defined in claim 31, wherein said plurality of possible settings includes a maximum speed setting.

38. A portable remote control device as defined in claim 37, wherein said control unit is operative to derive a specific speed associated to the maximum speed setting selected by the user.

39. A portable remote control device as defined in claim 38, wherein the specific speed associated to the maximum speed when said locomotive is in a first geographical region is different from the specific speed associated to the maximum speed when the locomotive is in a second geographical region.

40. A portable remote control device as defined in claim 39, wherein a Global Positioning System (GPS) is used to determine whether the locomotive is in the first geographical region or the second geographical region.

41. A portable remote control device as defined in claim 40, wherein a transponder system is used to determine whether the locomotive is in the first geographical region or the second geographical region.

42. A portable remote control device as defined in claim 39, wherein said first geographical region is a switchyard, and said second geographical region is outside a switchyard.

43. A portable remote control device as defined in claim 32, further comprising a user interface that is operative for receiving from a user the speed input data indicative of a setting selected by a user.

* * * * *